US005078354A

United States Patent [19]

Kim

[11] Patent Number: 5,078,354

[45] Date of Patent: Jan. 7, 1992

[54] SECTIONAL DECORATION BLOCK

[76] Inventor: Sung H. Kim, 462 - 130 Sungnam-dong, Jungwon-ku, Sungnam-shi, Kyungki-do, Rep. of Korea

[21] Appl. No.: 543,421

[22] Filed: Jun. 26, 1990

[30] Foreign Application Priority Data

Jun. 9, 1990 [KR] Rep. of Korea ..... 8251[U]

[51] Int. Cl.[5] ..... F16M 11/00

[52] U.S. Cl. ..... 248/176; 52/582; 446/123; 446/128

[58] Field of Search ..... 446/128, 112, 123; 248/176; 52/284, 286, 570, 568, 593, 595, 233, 582

[56] References Cited

U.S. PATENT DOCUMENTS

| | | | |
|---|---|---|---|
| 1,108,506 | 8/1914 | Couden | 52/582 |
| 1,941,436 | 12/1933 | Haupt | 52/28 X |
| 2,341,777 | 2/1944 | Hensel | 52/582 X |
| 3,594,028 | 7/1971 | Scott | 52/582 X |
| 4,455,807 | 6/1984 | Ehrlich | 52/582 X |
| 4,608,799 | 9/1986 | Hasegawa | 446/112 |
| 4,616,951 | 10/1986 | Maatela | 52/582 X |
| 4,688,362 | 8/1987 | Pedersen et al. | 52/233 |

FOREIGN PATENT DOCUMENTS

| | | | |
|---|---|---|---|
| 1315949 | 12/1961 | France | 446/128 |
| 979853 | 5/1961 | United Kingdom | 446/123 |

*Primary Examiner*—Ramon O. Ramirez
*Assistant Examiner*—Korie Chan
*Attorney, Agent, or Firm*—Fleit, Jacobson, Cohn, Price, Holman & Stern

[57] ABSTRACT

This invention relates to sectional decoration blocks of the type used as display stands for the display of electrical household appliances or ornaments in houses, hotels or restaurants. The block display stand of this invention is easily assembled even by a person of very meager skills since blocks and completed is identical with that of the red brick laying display stand. Further, there is produced no dust and noise when fabricating since no cement mortar for cementing blocks together is required.

9 Claims, 4 Drawing Sheets

SECTIONAL DECORATION BLOCK

BACKGROUND OF THE INVENTION

This invention relates to sectional decoration block adapted for use as display stands for the display of various household electric appliances or ornaments in a house, hotel or restrant.

Generally, various types of display stands have been used for the display of various household electric appliances or ornaments. One of such prior art display stands is constructed of layers of red bricks cemented together with mortar according to user's hobby.

However, it is almost impossible to fabricated the prior art brick display stand except by a very skillful person since the weight of the red bricks is substantial and the cement with mortar is complicated. Further, when it is desired to disassemble and modify the brick display stands. the retention of the original form of and reuse of the red bricks cannot be accomplished, thus requiring new bricks, which increases construction cost.

Another problem encountered in using the prior art red brick display stand also stems from the fact that clouds of dust raised during construction fouls the room and substantial time required for curing the cement mortar results in no immediate availability to the room.

SUMMARY OF THE INVENTION

An object of the present invention is to provide a sectional decoration block for adapted to be used as display stand wherein the block has the same effect as regular red bricks and is easy to handle due to its own light weight and is easily achieved without damaging to the appearance of the blocks.

Still another object of the present invention is to provide a sectional decoration block of the type used as display stand wherein no dust is raised during fabrication and no time is required for curing of the cement mortar, thereby the block display stand is available immidiately after fabrication.

A sectional decoration block of the present invention comprises a block body consisting of a block box having an opening bottom, a section defining means being mounted on said block box and smaller than said block box in length and width thereof, said block box having lengthwise and breadthwise extending step portions provided on the upper surface thereof and on the outer periphery of said section defining means, said section defining means having at least one bolt receiving hole on the upper face thereof, a connecting means consisting of an upper plate for abutting on either side against adjacent sides of said section defining means and T-shaped downwardly protrusions extending from both sides other than said sides abutting said section defining means and having an upper horizontal protrusion for abutting against adjacent lengthwise step portions of said block boxes and a downwardly extending protrusion in communication with said horizontal protrusion being inserted in space between adjacent blocks, said upper face having a bolt receiving hole 35 bored therethrough and a bolt for being inserted in a hole in said block body through said bolt receiving hole.

The objects and features of the present invention are set forth with particularity in the appended claims. The present invention may be best understood by reverence to the following description taken in connection with the accompanying drawings in which like indicate like parts.

DETAILED DESCRIPTION OF THIS INVENTION

Figure 1:
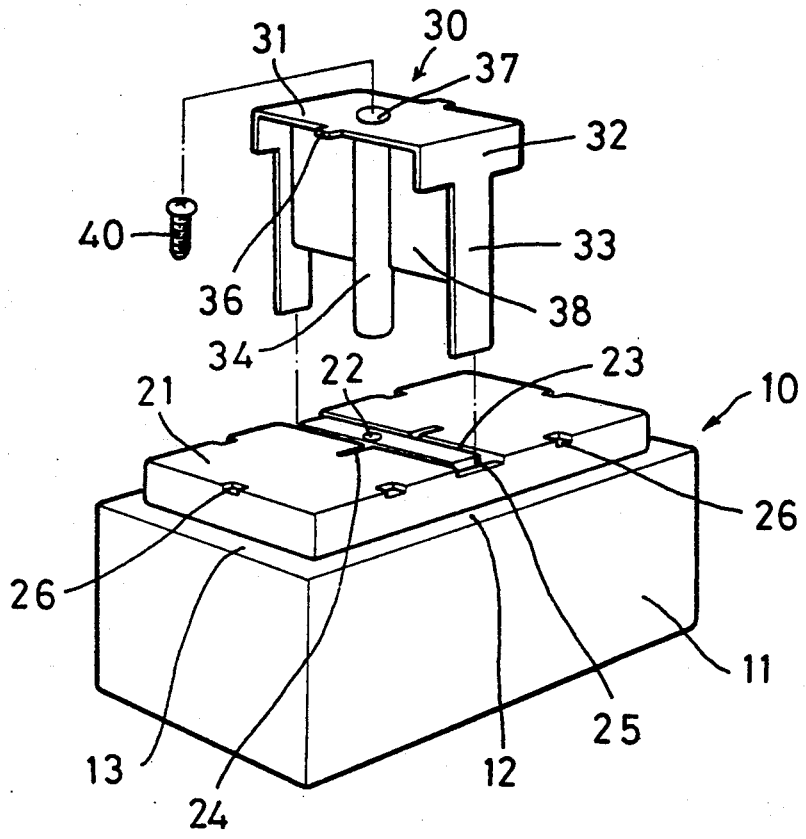
FIG. 1 is an exploded perspective view of the sectional blocks of this invention.
Figure 2:
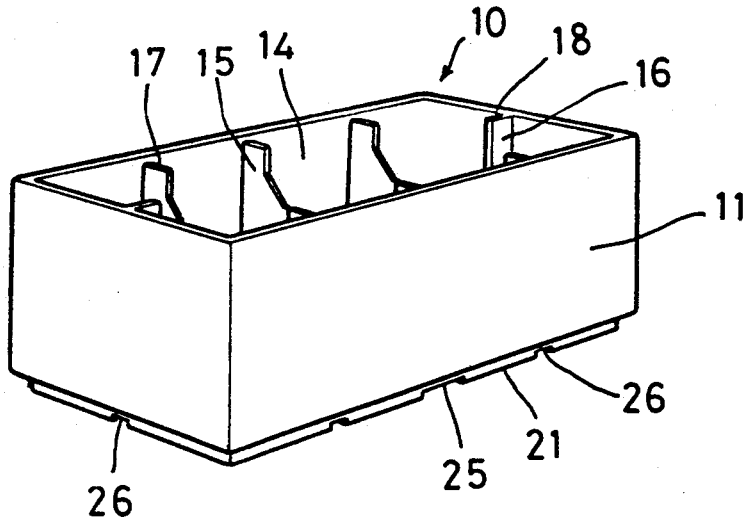
FIG. 2 is a perspective view of the block portion in reversed position.

Referring to the drawings, each of the sectional blocks of the present invention comprises a block body 10 and a section defining connecting means 30 for press fitting into middle space between the adjacent block bodies 10. In assembly, the section defining connecting means 30 is held in position by means of a bolt 40. It is noted that the appearance of the assembled block display stand of this invention is the same as that of the assembled red brick display stand.

The block body 10 comprises bottom-opening rectangular lower block box 11 incorporating an upper section defining portion 21 thereon. The upper section defining portion 21 is smaller than the lower block box 11 in length and width thereof, thus defining parallel lengthwise step portions 12 and breadthwise step portions 13. At least one fixed bolt receiving hole 22 is provided in the upper face of the upper section defining member 21.

The connecting means 30 comprises an upper plate 31 incorporating T-shaped downward extensions extending form both edges thereof. The T-shaped downward extensions defines a horizontally extending protrusion 32 for showing horizontal section and a vertically extending protrusion 33 for showing vertical section. A downwardly extending boss 34 extends form the center of the upper plate 31 and has center through bolt receiving bore 35 and tool receiving bore 37 having larger diameter than the bolt receiving bore 35 in communication with each other for receiving the fixed bolt 40 and a tool in turn, with the bore 35 being axially aligned with the fixed bolt receiving hole 22, thereby upper two and lower one blocks 10 are assembled securely to one another.

The bolt receiving bore 35 and hole 22 are not penetrated directly in the upper plate 31 and the section defining portion 21, but penetrated in the bosses 34, 27, thereby not decreasing the mechanical strength of the assembly.

As described in detail later in the examples of assembly manner, the boss 34 is axially aligned with the fixed bolt receiving hole 22, thus bolting to the block body 10 by passing the bolt 40 through the bore 35 and hole 22.

When inserted, the section defining connecting means 30 exerts the force on the breadthwise step portions 13 of the adjacent block bodies 10 at the horizontally extending protrusion 32 and on shoulders 25 at the bottom of the vertically extending protrusion 33 for secure assembly of two upper and one lower block bodies 10. The block body 10 and the connecting means 30 are of plastic material. The block box 11 is molded in black and then coated with red stone dust to have the same appearance and character as ordinary red bricks, while the upper section defining portion 21 maintains black in its color.

The section defining portion 21 is smaller than the inner space 14 of block box 11 in length and width thereof for insertion to the inner space 14 from the direction of open bottom of the block box 11.

Each width of lengthwise and breadthwise step portions 12,13 of the block box 11 is the same as each extended length from the one side horizontally extending protrusion 32 so that the horizontally extending protrusion 32 pressedly abuts the step portion 12,13 at bottom portions thereof when inserted.

The vertically extending protrusion 33 is dimensioned to have the same width as the shown width when assembled, while each of the horizontally extending protrusion 32 and the section defining portion 21 are dimensioned to have larger height than the shown height when assembled in view of the inserted portion.

The block box 11 incorporates, within the inner space 14, a plurality of lengthwise protruding reinforcing ribs 15 extended from the opening bottom and having a same level end portion 17 for preventing lengthwise movement and a plurality of breadthwise protruding reinforcing ribs 16 extended above the openning bottom thereof and having a step portion 18 for preventing breadthwise movement.

A pair of parallel grooves 23 spaced the same distance from center axis of the section defining portion 21 are inserted by a lower periphery of the block box 11 for preventing lengthwise movement. Communicating with and perpendicular to the center of each of the groove 23 is provided a slot 24 for being inserted by the step portion 18, thus preventing lengthwise movement.

Adjacent and displaced in an relationship with the groove 23 are provided a pair of parallel spaced shoulders 25 for engaging the bottom face of the T-shaped portion. A plurality of peripheral square slots 26 are provided on the periphery of the section defining portion 21 for fixedly engaging upper extending square protrusions 36 of the upper plate 31.

It is desirable that the thickness of the block box wall, the thicknesses of the step portion 17, same level step portion 18, upper extending protrusions 36 and the widths of the peripheral slots 26, shoulders 25 be dimensioned to be the same for having interchangeability when assembled.

Figure 7:
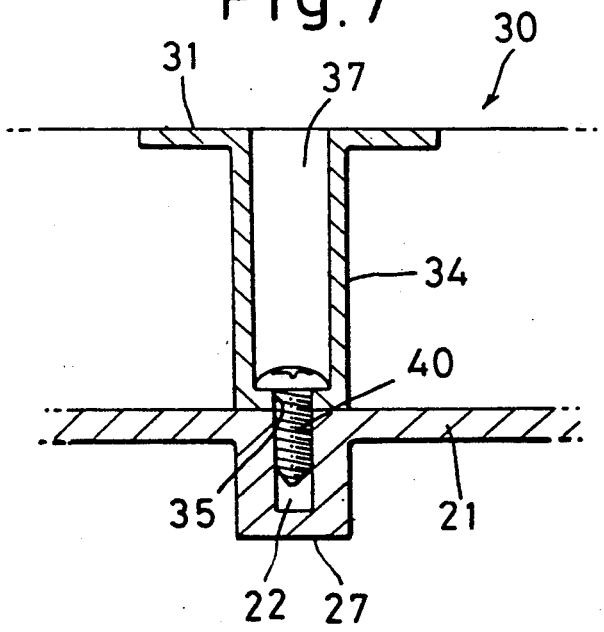
FIG. 7 is a enlarged sectional view of the fixed screw in fixing position.

It doesn't matter that the fixed bolt receiving hole 22 may be provided in the upper face of the section defining portion 21. However, for increasing mechanical strength, it is desirable that the fixed bolt receiving hole 22 be provided in the boss 27 inserted in the inner space 14. However, as shown in FIG. 7, it is desirable that the bore 35 be provided in the lower shorter end of the boss 34 for receiving the short fixed bolt 40 and for remaining the upper space to be served as a tool receiving bore 37.

The upper plate 31, T-shaped horizontally and vertically extending protrusion 32,33 of the connecting means 30 and the boss 34 are integrally formed with one another by means of reinforcing ribs 38 for increasing mechanical strength.

With this construction, the decoration blocks 10 are fabricated in various manner as in that by the red bricks. lengthwise and cross assembly manner is described below.

Figure 3:
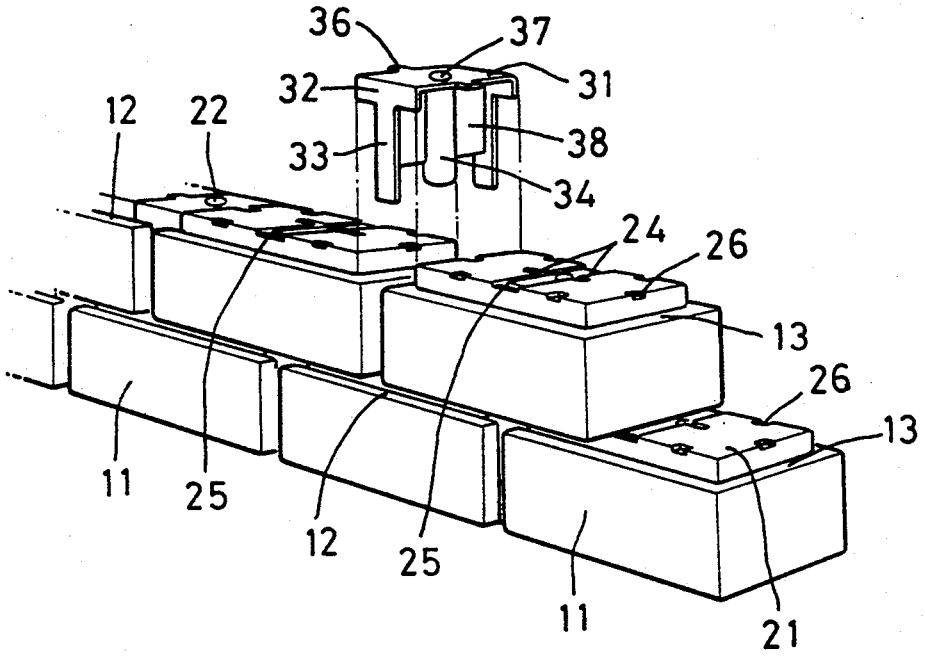
FIG. 3 is a perspective view of the blocks of this invention in lateral assembly to one another.
Figure 4:
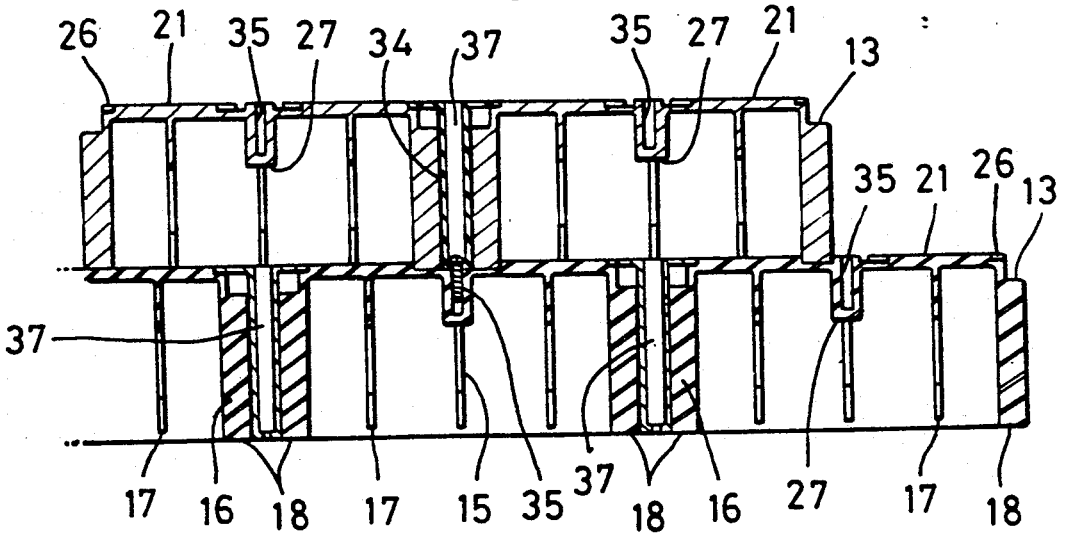
FIG. 4 is a sectional view of a portion of FIG. 3.

FIGS. 3 and 4 show the assembly of the decoration blocks 10 in lengthwise direction wherein a plurality of blocks 10 are arranged in lengthwise direction, with the section defining portion 21 being faced upwardly. The connecting means 30 is inserted between the adjacent blocks with the vertically extending protrusion 33 being between side face of the blocks 10 and the horizontally extending protrusion 32 abutting closely against the breadthwise extending step portion 13 of the adjacent two blocks 10 at the bottom faces thereof, thus defining vertical and horizontal sections.

When assembled, the lower two blocks and the upper one block between the lower two blocks are engaged with one another.

The upper blocks 10 engages the lower section defining portion 21, with the lower periphery of the upper blocks 10 being inserted in the smaller slots 24, thus preventing the lengthwise and breadthwise movement.

The longer grooves 23 are spaced from each other the distance corresponding to the width of the longitudinal protrusion 33, thereby the distance between the adjacent upper two blocks 10 comes to that corresponding to the width of the longitudinal protrusion 33, this distance being the desired shown distance.

When a decoration block display stand of desired length and height is completed in its assembly in a manner as described as above, the upper face of the section defining means 21 is exposed at the top, on which is mounted glass plate or decoration plate for mounting various electrical household appliances or ornaments.

Figure 5:
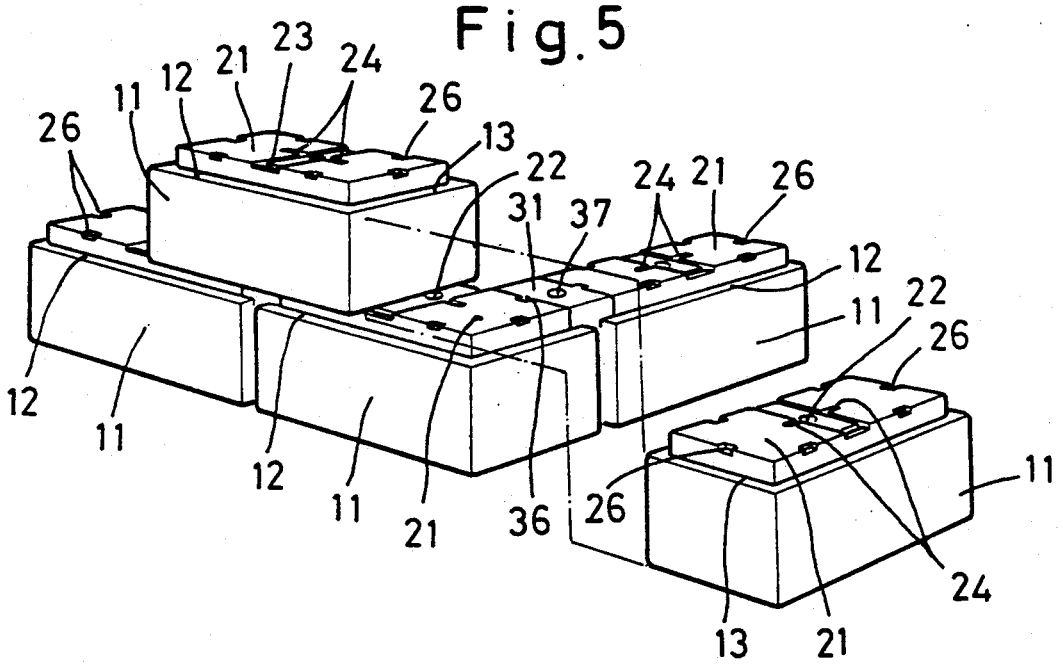
FIG. 5 is a perspective view of the blocks of this invention in assembly to one another at the corner portions.
Figure 6:
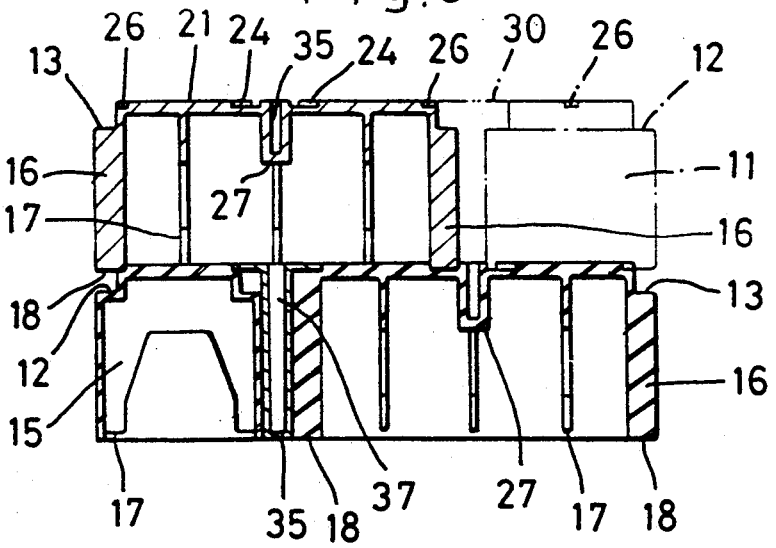
FIG. 6 is a sectional view of a portion of FIG. 5.

FIGS. 5 and 6 show the assembly of the blocks in an angular relationship, wherein two lower blocks 10 are assembled in lengthwise direction and another block 10 is disposed at a right angle to one of the lengthwise assembled blocks. The connecting means 30 is inserted between angularly disposed two blocks at the vertical extending protrusions 33, with the horizontal portion 32 abutting against one of the lengthwise extending step portion 12 of one block 10 and one of the breadthwise extending portion 13 of the other block 10, thus defining horizontal and vertical sections.

The lengthwise assembly of blocks to the angularly disposed block 10 is the same as described as above. When assembled, upper one and lower two blocks are engaged with another. The assembly processes according to the usual block-laying manner. That is, on and between the lower blocks, one upper block is engagably mounted and then another upper block is displaced at a right angle to the middle upper block on one of the lower lengthwise assembled block.

The upper angular displaced block 10 engages and bridges over the lower two blocks disposed in an angular relationship to each other with longer periphery of the one half being inserted in one of the longer grooves 23 and shorter periphery and the same-level protrusions 18 of the other half being respectively to the one of the longer grooves 23 and shorter slots 24, thereby one upper and two lower blocks is fixedly engaged and prevented lengthwise and breadthwise movement when assembled.

With this assembly, desired shown space corresponding to the width of the longitudinal protrusion 33 is provided between the facing surfaces of the adjacent lengthwise assembled block and the breadthwise assembled block. Through the space the longitudinal protrusion 33 is inserted for defining longitudinal section. The horizontal protrusion 32 closely abuts against the lengthwise and breadthwise step portions 12, 13 for defining horizontal section. Also in this case, the fixed bolt receiving bore 35 and hole 22 are axially aligned with each other for receiving the fixed bolt 40 as in the manner described above.

When the assembly is completed, the block display stand is identical with the ordinary red brick display stand in the appearance thereof even in the appearance of the section defining portions.

The decoration block display stand of the present invention is easily assembled by a person of very meager mechanical skills since the block body and connecting means are composed of plastic material. It is noted that the disassembly of the assembled display stand is accomplished in a reverse manner.

It will be apparent on those skilled in the art that various modifications of the present invention are possible and accordingly the scope of the present invention should be interpreted solely form the following claims.

What is claimed is:

1. A sectional decoration block suitable for use in constructing a display stand by forming superimposed rows of block bodies which are staggered in adjacent rows in simulation of brickwork, said block comprising:

a block body including a block box having an open bottom, a section defining portion mounted on an upper surface of said block box and smaller than said block box in length and width, said block box having lengthwise and breadthwise extending step portions on the upper surface thereof surrounding said section defining portion, said section defining portion having a bolt receiving hole in an upper face thereof;

a connecting element for insertion into a space between a pair of adjacent block bodies and for connection to a block body beneath the adjacent block bodies, said element comprising an upper plate having side edges against adjacent section defining portions of the pair of adjacent block bodies and T-shaped protrusions extending downwardly from opposite side edges of said plate other than the side edges for abutting said section defining portions, each T-shaped protrusion having upper horizontal protrusions for abutting against adjacent lengthwise step portions of said block bodies and a downwardly extending protrusion for being inserted into the space between the adjacent block bodies, said upper plate having a bolt receiving bore formed therethrough; and a bolt for being inserted in the bolt-receiving hole in said block body beneath the adjacent block bodies through said bolt receiving bore in the connecting element.

2. A sectional decoration block according to claim 1, wherein said block body and said connecting element are composed of plastic material, said block body is coated with red stone dust except said section defining portion and said connecting element is molded with the same color as the color of the section defining portion.

3. A sectional decoration block according to claim 1, wherein said lengthwise and breadthwise extending step portion of said block box is substantially identical in width with the length of one horizontal protrusion of said connecting means.

4. A sectional decoration block according to claim 1, wherein said block box has an interior space and a plurality of lengthwise and breadthwise extending reinforcing ribs formed integrally therewith in the interior space thereof.

5. A sectional decoration block according to claim 4, wherein said breadthwise extending reinforcing ribs are mounted above said open bottom of said block box for preventing lengthwise movement when assembled, said lengthwise extending reinforcing ribs begin from said open bottom of said block box for preventing breadthwise movement when assembled, said section defining means has a pair of parallel grooves for receiving the lower periphery of said block box, said parallel grooves being spaced the same distance from the breadthwise axis of said section defining means, said section defining means further having cross slots perpendicular to said grooves for receiving said lengthwise extending reinforcing ribs.

6. A sectional decoration block according to claim 1, wherein said connecting element incorporates protrusions extending from said upper plate and said section defining portions have matching slots for engaging said protrusions.

7. A sectional decoration block according to claim 1, wherein said bolt receiving hole in said section defining portion is formed in a boss which extends into said block box.

8. A sectional decoration block according to claim 1, wherein said bolt receiving bore in said connecting element extends into a boss which extends downwardly from said upper plate to form a tool receiving chamber and the boss has a lower end having a bolt hole therein for communication with said bolt receiving hole of the lower block body.

9. A sectional decoration block according to claim 8, wherein said connecting element incorporates reinforcing ribs for integrally connecting said upper plate, said T-shaped protrusions and said boss.

* * * * *